US005551787A

United States Patent [19]

Rosenthal

[11] Patent Number: 5,551,787

[45] Date of Patent: Sep. 3, 1996

[54] WAX PENCIL HOLDING DEVICE AND SHARPENER

[76] Inventor: Donald M. Rosenthal, 3780 Elmira Ave., Claremont, Calif. 91711

[21] Appl. No.: 511,800

[22] Filed: Aug. 7, 1995

[51] Int. Cl.[6] ..... B43K 29/06; B43K 21/08

[52] U.S. Cl. ..... 401/50; 401/75; 401/174; 401/88

[58] Field of Search ..... 401/50, 51, 75, 401/79, 174, 88

[56] References Cited

U.S. PATENT DOCUMENTS

| | | | |
|---|---|---|---|
| 955,617 | 4/1910 | Tucker | 401/79 |
| 1,510,618 | 10/1924 | Bell | 401/75 |
| 2,333,714 | 11/1943 | Fletcher | 401/50 X |
| 2,563,943 | 8/1951 | Kruck | 401/75 |
| 3,232,275 | 2/1966 | Ziegler et al. | 401/51 |
| 3,768,915 | 10/1973 | Spatz | 401/50 |

FOREIGN PATENT DOCUMENTS

| | | | |
|---|---|---|---|
| 436110 | 6/1948 | Italy | 401/174 |
| 516189 | 12/1939 | United Kingdom | 401/75 |

*Primary Examiner*—Steven A. Bratlie

[57] ABSTRACT

A device for supporting a wax pencil for writing. The inventive device includes a main body for receiving a wax pencil therewithin. A knob is rotatably mounted to an end of the main body and supports a threaded rod projecting thereinto. A plunger is engaged to the threaded rod and can be advanced therefrom to bias a desired portion of the wax pencil from the main body for use in a writing procedure.

1 Claim, 3 Drawing Sheets

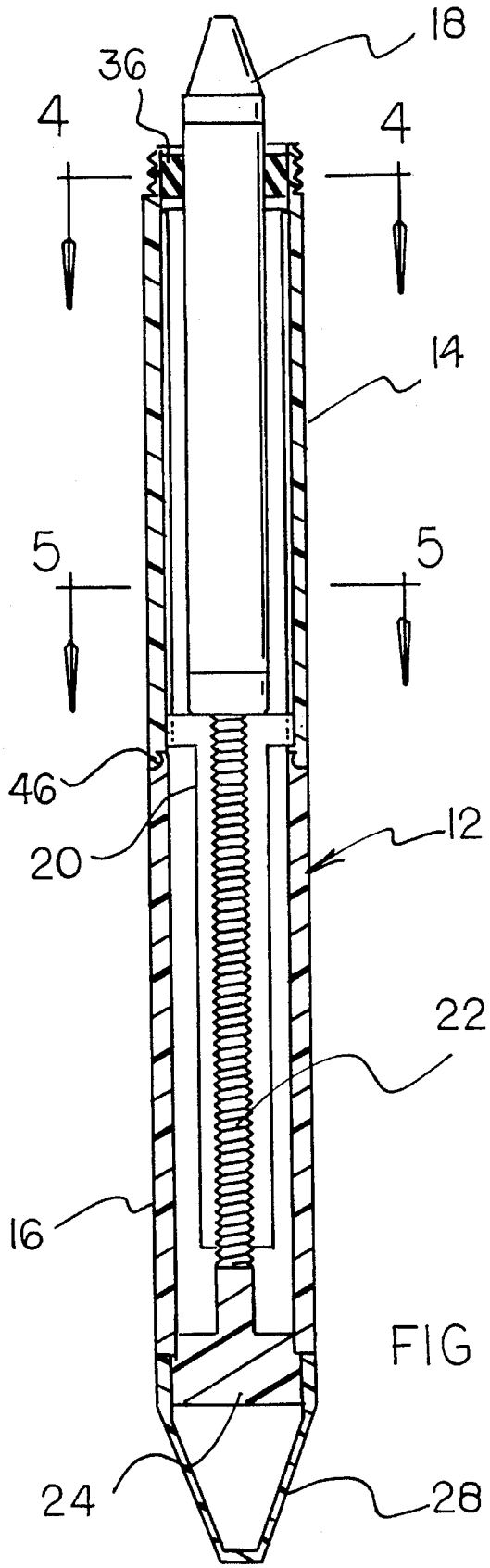
FIG 3
FIG 4
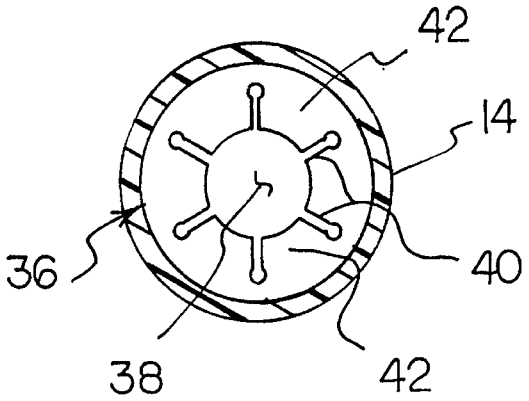
FIG 5
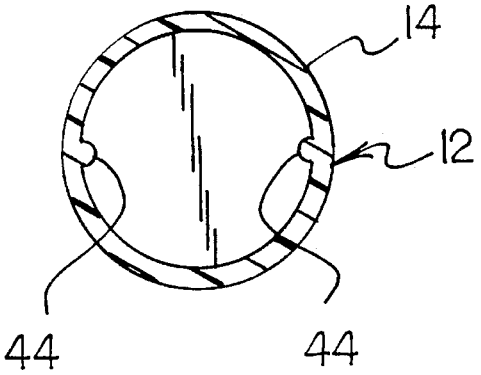

WAX PENCIL HOLDING DEVICE AND SHARPENER

BACKGROUND OF THE INVENTION

1. Field of the Invention

The present invention relates to writing instrument structures and more particularly pertains to a wax pencil holding device for supporting a wax pencil for writing.

2. Description of the Prior Art

The use of writing instrument structures is known in the prior art. More specifically, writing instrument structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art writing instrument structures include U.S. Pat. Nos. 4,468,146; 5,048,989; 4,991,299; 5,076,444; U.S. Pat. Nos. Des. 290,854; and 332,281.

While these devices fulfill their respective, particular objectives an, requirements, the aforementioned patents do not disclose a wax pencil holding device for supporting a wax pencil for writing which includes a main body for receiving a wax pencil therewithin, a knob rotatably mounted to a end of the main body and supporting a threaded rod projecting thereinto, and a plunger engaged to the threaded rod which can be advanced therefrom to bias a desired portion of the wax pencil from the main body for use in a writing procedure.

In these respects, the wax pencil holding device according to the present invention substantially departs from the conventional concepts and designs of the prior art, and in so doing provides an apparatus primarily developed for the purpose of supporting a wax pencil for writing.

SUMMARY OF THE INVENTION

In view of the foregoing disadvantages inherent in the known types of writing instrument structures now present in the prior art, the present invention provides a new wax pencil holding device construction wherein the same can be utilized for supporting a wax for writing. As such, the general purpose of the present invention, which will be described subsequently in greater detail, is to provide a new wax pencil holding device apparatus and method which has many of the advantages of the writing instrument structures mentioned heretofore and many novel features that result in a wax pencil holding device which is not anticipated, rendered obvious, suggested, or even implied by any of the prior an writing instrument structures, either alone or in any combination thereof.

To attain this, the present invention generally comprises a device for supporting a wax pencil for writing. The inventive device includes a main body for receiving a wax pencil therewithin. A knob is rotatably mounted to an end of the main body and supports a threaded rod projecting thereinto. A plunger is engaged to the threaded rod and can be advanced therefrom to bias a desired portion of the wax pencil from the main body for use in a writing procedure.

There has thus been outlined, rather broadly, the more important feature of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new wax pencil holding device apparatus and method which has many of the advantages of the writing instrument structures mentioned heretofore and many novel features that result in a wax pencil holding device which is not anticipated, rendered obvious, suggested, or even implied by any of the prior art tool guides, either alone or in any combination thereof.

It is another object of the present invention to provide a new wax pencil holding device which may be easily and efficiently manufactured and marketed.

It is a further object of the present invention to provide a new wax pencil holding device which is of a durable and reliable construction.

An even further object of the present invention is to provide a new wax pencil holding device which is susceptible of a low cost of manufacture with regard to both materials and labor, and which accordingly is then susceptible of low prices of sale to the consuming public, thereby making such wax pencil holding devices economically available to the buying public.

Still yet another object of the present invention is to provide a new wax pencil holding device which provides in the apparatuses and methods of the prior art some of the advantages thereof, while simultaneously overcoming some of the disadvantages normally associated therewith.

Still another object of the present invention is to provide a new wax pencil holding device for supporting a wax pencil for writing.

Yet another object of the present invention is to provide a new wax pencil holding device which includes a main body for receiving a wax pencil therewithin, a knob rotatably mounted to a end of the main body and supporting a threaded rod projecting thereinto, and a plunger engaged to the threaded rod which can be advanced therefrom to bias a desired portion of the wax pencil from the main body for use in a writing procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is a cross sectional view taken along line 4—4 of FIG. 3.

FIG. 5 is a cross sectional view taken along line 5—5 of FIG. 3.

DESCRIPTION OF THE PREFERRED EMBODIMENT

Figure 1:
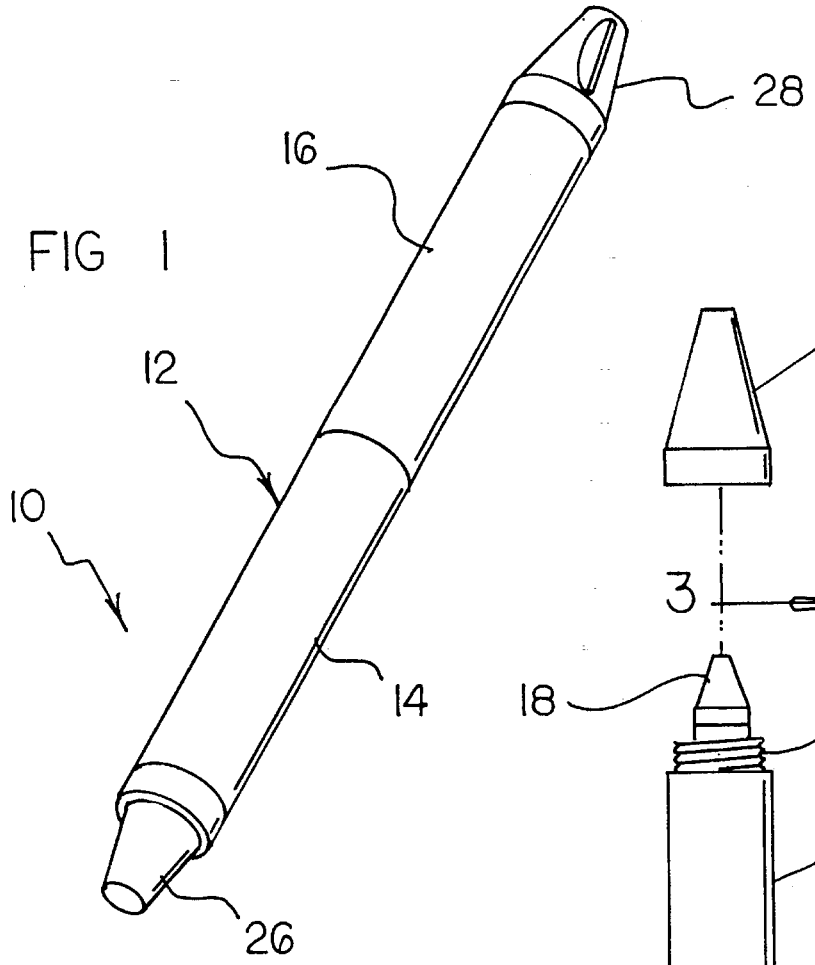
FIG. 1 is an isometric illustration of a wax pencil holding device according to the present invention.

With reference now to the drawings, and in particular to FIGS. 1–6 thereof, a new wax pencil holding device embodying the principles and concepts of the present invention and generally designated by the reference numeral 10 will be described.

More specifically, it will be noted that the wax pencil holding device 10 comprises an elongated main body 12 including a first portion 14 removably coupled to a second portion 16 substantially as shown in FIG. 1 of the drawings. A wax pencil 18 can be removably received within the first portion 14 of the main body 12. As shown in FIG. 3, a plunger 20 is slidably mounted within the main body 12 and abuttingly engages an interior end of the wax pencil 18 when positioned within the main body as shown in the drawings. A threaded rod 22 is threadably engaged to the plunger 20 and extends therefrom towards an end of the main body 12 whereat a knob 24 is rotatably mounted. The knob 24 is coupled to the threaded rod 22 such that a rotation of the knob will effect concurrent rotation of the threaded rod relative to the plunger 20 so as to effect axial movement of the plunger within the main body 12. By this structure, a wax pencil 18 can be inserted into the main body 12 and adjustably supported relative thereto through a manual axial positioning of the plunger 20 within the main body 12 accomplished through a rotation of the knob 24 so as to cause desired amount of the wax pencil 18 to project from the main body 12 for use in writing procedure.

Figure 2:
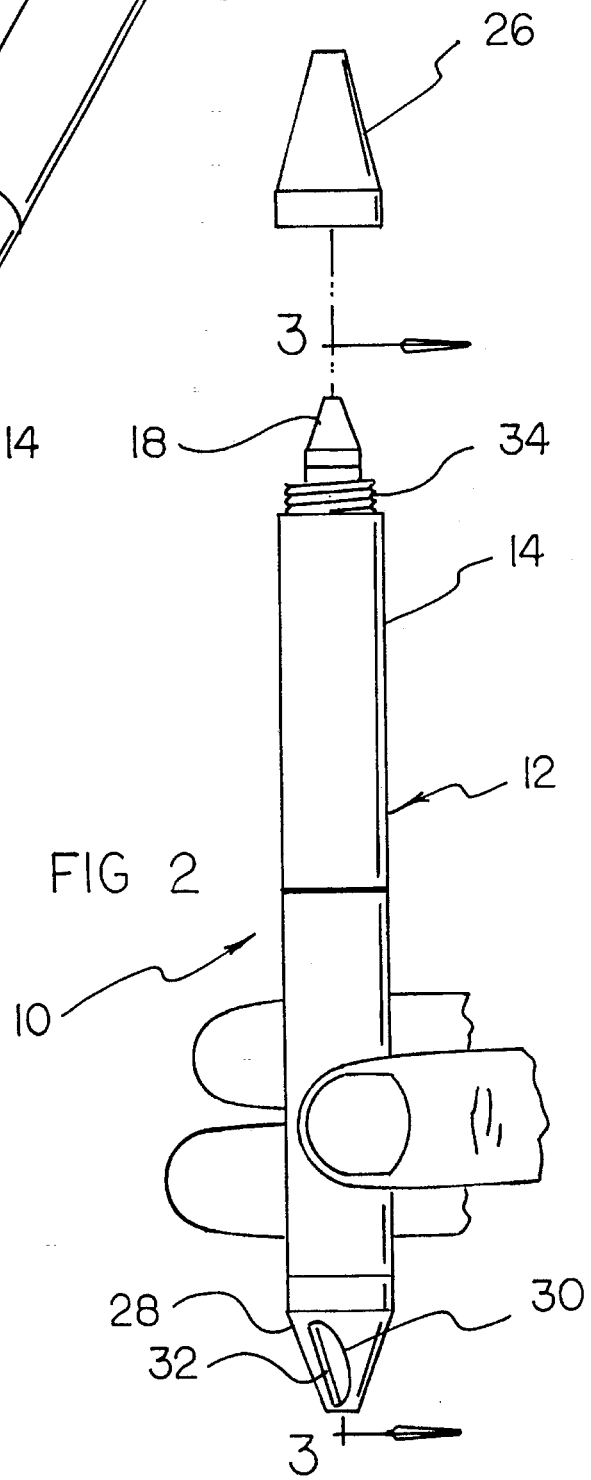
FIG. 2 is an exploded elevation view of the invention.

As best illustrated in FIGS. 1 and 2, it can be shown that the preset invention 10 may further comprise a cover cap 26 removably coupled to the first portion 14 of the main body 12 so as to enclosure the wax pencil 18 therewithin. Further, a sharpener cap 28 can be removably frictionally coupled to the knob 24 mounted to the second portion 16 of tile main body 12. The sharpener cap 28 is operable to be selectively decoupled from the knob 20 and engaged to a writing end of the wax pencil 18 to effect sharpening thereof. To this end, the sharpener cap 28 is shaped so as to define an aperture 30 extending therethrough with a cutting blade 32 being mounted along an interior surface of the sharpener cap 28 so as to effect cutting of the wax pencil 18 with severed portions thereof being ejected from the sharpener cap 28 through the aperture 30 thereof. The cover cap 26 may be removably coupled to the first portion 14 of the main body 12, the first portion 14 of the main body desirably includes a threaded neck 34 projecting therefrom which threadably engages an interior portion of the cover cap 26.

Figure 6:
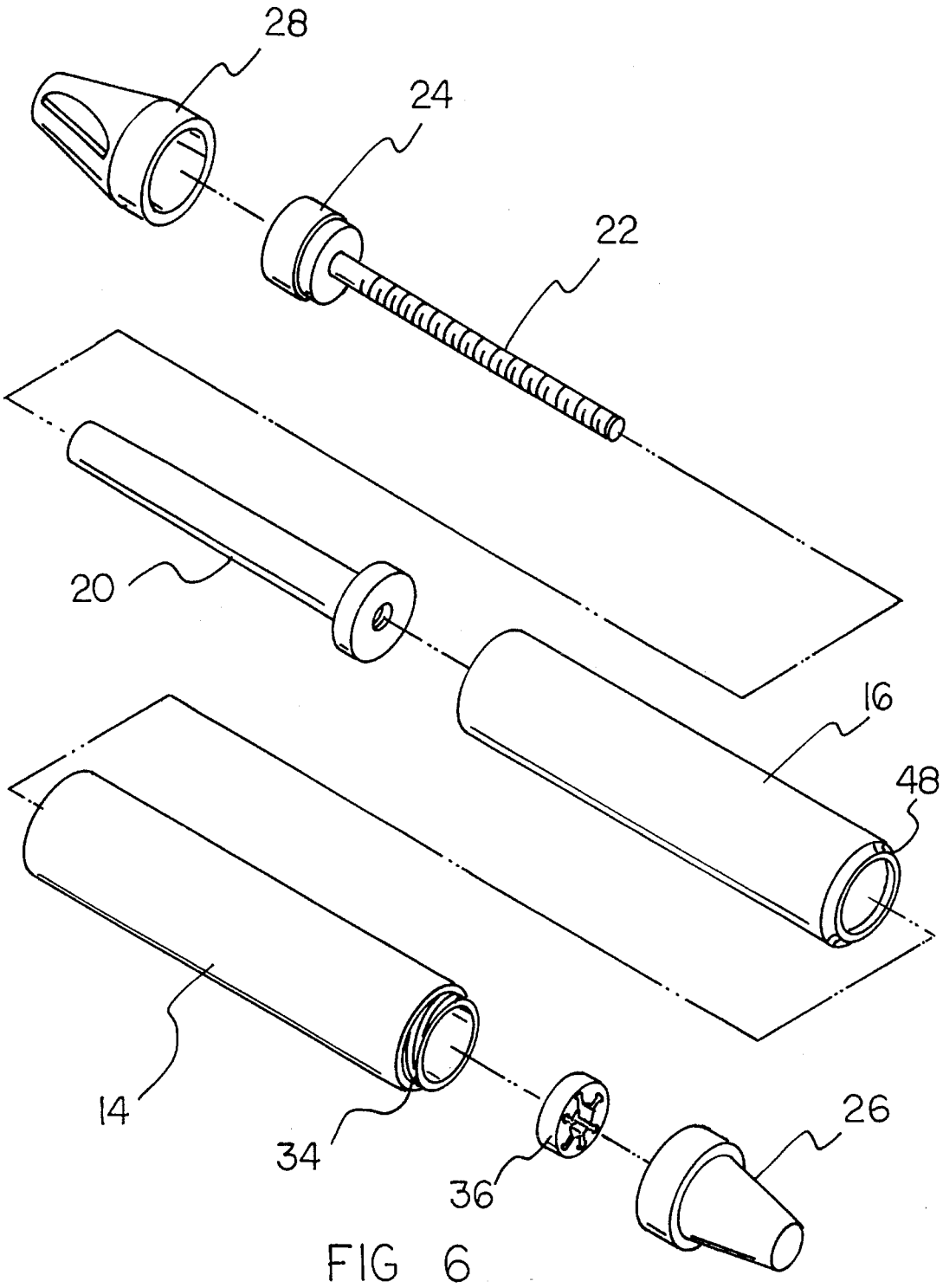
FIG. 6 is an exploded isometric illustration of the present invention.

Referring now to FIGS. 4 through 6, it can be shown that the present invention 10 further comprises a concentric support member 36 removably positioned within the first portion 14 of the main body 12 so as to permit the accommodation of a slender or thin wax pencil 18 therewithin. In other words, a relatively large or thick wax pencil 18 can be positioned within the first portion 14, with a relatively thin or small wax pencil 18 also being positioned within the first portion 14 in conjunction with the concentric support member 36, whereby the concentric support member operates to radially support the thin wax pencil 18 concentrically within the first portion 14 of the main body 12. To this end, and as specifically shown in FIG. 4, the concentric support member 36 is shaped so as to define a center aperture 38 directed therethrough which receives the wax pencil 18 therethrough. Further, the concentric support member 36 is shaped so as to define a plurality of radial apertures 40 extending from contiguous communication with the center aperture 38 and radially outwardly therefrom. The radial apertures 40 thus cooperate to define a plurality of resilient projections 42 which are cantilevered from an outer peripheral portion of the concentric support member 36 and resiliently engage an exterior surface of the wax pencil 18 when positioned through the center aperture 38 of the concentric support member 36. By this structure, the concentric support member 36 can support thin wax pencils 18 of varying outer diameters. In other words, the resilient projections 42 can resiliently deform so as to accommodate for variations in a thickness or diameter of a particular wax pencil 18 inserted through the center aperture 38 of the concentric support member 36.

With continuing reference to FIGS. 5 and 6, it can be shown that the plunger 20 is movably supported within the first portion 14 of the main body 12 and precluded from rotation relative thereto by a plurality of longitudinal projections 44 extending along diametrically opposed interior surfaces of the first portion 14 of the main body 12. The longitudinal projections 44 thus engage corresponding longitudinal grooves within the plunger 20 so as to slidably yet non-rotatably mount the plunger 20 within the main body 12. By this structure, a rotation of the knob 24 will effect concurrent rotation of the threaded rod 22 relative to the main body 12 and the plunger 20 non-rotatably affixed thereto so as to cause an axially advancement of the plunger 20 within the main body 12.

Referring to FIG. 3 with concurrent reference to FIG. 6, it can be shown that the second portion 16 of the main body 12 is removably coupled to the first portion 14. To this end, the first portion 14 is shaped so as to define an annular projection 46 extending radially inwardly therefrom which cooperatively engages an annular groove 48 extending into the second portion 16 of the main body 12. By this structure, the second portion 16 is easily snap-fitted into the first portion 14 so as to removably couple the portions of the main body 12 together.

As shown in FIG. 6, the present invention 10 may be easily deconstructed for cleaning and/or servicing of the components.

In use, the wax pencil holding device 10 of the present invention can be easily utilized for supporting a wax pencil during a writing procedure. The cover cap 26 substantially protects a writing end of the wax pencil 18 during periods of non-use thereof, with the sharpener cap 28 being selectively useable by an individual as described above to effect restoration or sharpening of the writing end of the wax pencil when desired.

As to a further discussion of tire manner of usage and operation of the present invention, the same should be apparent froth the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, tire foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wax pencil holding device comprising:

an elongated main body including a first portion removably coupled to a second portion, the first portion of the main body includes a threaded neck projecting therefrom;

the first portion of the main body is shaped so as to define an annular projection extending radially inwardly therefrom, and the second portion of the main body being shaped so as to define an annular groove extending thereinto, with the annular projection being removably coupled to and positioned within the annular groove of the second portion;

a thin wax pencil removably received within the first portion of the main body;

a concentric support member removably positioned within the first portion of the main body and concentrically positioned about the thin wax pencil therewithin, the concentric support member is shaped so as to define a center aperture directed therethrough which receives the wax pencil therethrough, and a plurality of radial apertures extending from contiguous communication with the center aperture and radially outwardly therefrom so as to define a plurality of resilient projections which are cantilevered from an outer peripheral portion of the concentric support member and resiliently engage an exterior surface of the wax pencil;

a plunger slidably mounted within the main body and abuttingly engaging an interior end of the wax pencil, the plunger is movably supported within the first portion of the main body and precluded from rotation relative thereto by a plurality of longitudinal projections extending along diametrically opposed interior surfaces of the first portion of the main body, with the plunger being shaped so as to define longitudinal grooves such that the longitudinal projections engage the longitudinal grooves within the plunger to slidably and non-rotatably mount the plunger within the main body;

a threaded rod threadably engaged to the plunger and extending therefrom towards an end of the second portion of the main body;

a knob is rotatably mounted to the end of the second portion of the main body and secured to the threaded rod such that a rotation of the knob will effect concurrent rotation of the threaded rod relative to the plunger so as to effect axial movement of the plunger within the main body;

a cover cap removably coupled to the first portion of the main body so as to enclosure the wax pencil therewithin, the cover cap having an interior portion being capable of threadably engaging the neck of the first portion; and a sharpener cap removably coupled to the knob, the sharpener can be selectively decoupled from the knob and engaged to a writing end of the wax pencil to effect sharpening thereof, the sharpener cap is shaped so as to define an aperture extending therethrough with a cutting blade being mounted along an interior surface of the sharpener cap so as to effect cutting of the wax pencil with severed portions thereof being ejected from the sharpener cap through the aperture thereof.

* * * * *